United States Patent [19]

Tanioka et al.

[11] Patent Number: 4,617,248

[45] Date of Patent: Oct. 14, 1986

[54] DOPED PHOTOCONDUCTIVE FILM INCLUDING SELENIUM AND TELLURIUM

[75] Inventors: Kenkichi Tanioka, Tokyo; Keiichi Shidara, Tama; Takao Kuriyama, Sagamihara; Yukio Takasaki, Kawasaki; Tadaaki Hirai, Koganei; Yasuhiko Nonaka; Eisuke Inoue, both of Mobara, all of Japan

[73] Assignees: Nippon Hoso Kyokai; Hitachi, Ltd., both of Tokyo, Japan

[21] Appl. No.: 736,149

[22] Filed: May 20, 1985

[30] Foreign Application Priority Data

May 21, 1984 [JP] Japan ..... 59-100535

[51] Int. Cl.[4] ..... G03G 5/08; G03G 5/09

[52] U.S. Cl. ..... 430/95; 430/57; 430/61

[58] Field of Search ..... 430/95, 57, 86, 61; 313/386

[56] References Cited

U.S. PATENT DOCUMENTS

| | | | |
|---|---|---|---|
| 3,890,525 | 6/1975 | Hirai et al. | 313/386 |
| 4,040,985 | 8/1977 | Shidara et al. | 428/457 |
| 4,463,279 | 7/1984 | Shidara et al. | 430/95 |

*Primary Examiner*—John L. Goodrow

*Attorney, Agent, or Firm*—Antonelli, Terry & Wands

[57] ABSTRACT

A structure of a photoconductive film related to a target of an image pickup tube of the photo conductivity type is disclosed. This photoconductive film is formed from mainly Se and Te is added in a central part thereof. Further, As, which is considered to form a deep trap level which captures electrons in Se and $GaF_3$, etc. which form negative space charges by capturing electrons in Se are added in the region adjacent to the region where Te exists. In addition, a thickness of film in the region where $GaF_3$, etc. exists is selected to be thinner (not smaller than 20 Å and not larger than 90 Å) than a value which has been adopted so far.

13 Claims, 5 Drawing Figures

DOPED PHOTOCONDUCTIVE FILM INCLUDING SELENIUM AND TELLURIUM

BACKGROUND OF THE INVENTION

The present invention relates to a structure of a photoconductive film which is used for a target of a photoconductive image pickup tube and, more particularly, to a photoconductive film which can decrease a drift in sensitivity just after the image pickup tube is switched on among the photo response properties of the rectifying contact type photoconductive film.

As is well known, amorphous Se exhibits a photoconductivity and a photoconductive film of the rectifying contact type can be produced by combining this amorphous Se with a signal electrode of an n-type conductivity. In this case, since Se doesn't have a sensitivity to the long wavelength light, a method whereby Te is added into a part of the Se film is adopted to improve the above-mentioned sensitivity (U.S. Pat. Nos. 3,890,525 and 4,040,985 and Japanese Pat. No. 1083551 (Publication No. Sho. 56-6628)).

On one hand, to decrease the after image to the strong light, a method whereby $GaF_3$, $MoO_3$, $In_2O_3$, etc. are added into a part of the Se film is adopted (U.S. Pat. No. 4,463,279). FIG. 1 shows a principal structure diagram of the target according to a conventional technology. In this diagram, a reference numeral 1 denotes a transparent substrate; 2 is a transparent electrode; 3 a photosensitizing part of p-type photoconductor; 4 a p-type photoconductive film serving as a layer to reduce the storage capacitance of the target; and 5 an auxiliary layer for assisting the landing of an electron beam. The photo-sensitizing part 3 consists of Se, As, Te, and $GaF_3$; the p-type photoconductive film 4 consists of Se and As; and the beam landing aiding layer 5 consists of $Sb_2S_3$. FIG. 2 shows an example of component distribution in the direction of the film thickness of the photo-sensitizing part 3 in FIG. 1. In this example, Te for increasing the sensitivity doesn't exist at all at the position (position indicated by a) corresponding to the interface with the transparent electrode 2 where the film thickness is zero. The concentration of Te rapidly increases from the position of the film thickness of 500 Å and Te is added into the region (portion b) over 1000 Å thick to the position of the film thickness of 1500 Å. Substance As added into the portions a and b serves to increase the thermal stability of Se. Substances As and $GaF_3$ are added into the portion indicated by c, in which it is considered that As serves to form a deep trap level to capture electrons in Se and $GaF_3$ serves to form negative space charges by capturing the electrons in Se. The portion c allows the after image for the strong light to be decreased and simultaneously permits the sensitizing effect to be increased. The concentration of As decreases over the film thickness of 1000 Å at a uniform gradient. The concentration distribution of $GaF_3$ is uniform over the film thickness of 1000 Å. The target having such a structure can attain the object of increasing the sensitivity to the long wavelength light and to decrease the after image to the strong light, while the properties such as the lag, resolution and the like which are ordinarily required as an image pickup tube are good. However, this target has a drawback such that if the film thickness of the region where the negative space charges are formed is thick, time drift in sensitivity just after the image pickup tube is switched on is large.

SUMMARY OF THE INVENTION

It is an object of the present invention to provide a target which can decrease a drift in sensitivity just after the image pickup tube is switched on without losing the sensitizing effect for light.

In this invention, to accomplish the above object, it is an essential point that the layer for increasing the sensitizing effect by forming the trap level at which the electrons are captured in Se (hereinafter, this layer is referred to as an auxiliary sensitizing layer) in the photosensitizing part of p-type photoconductor is made thin.

The carriers produced in the portions (photosensitive layers) a and b in FIG. 2 by an incident light are effectively drawn out as a signal current by the action of the portion c, namely, the auxiliary sensitizing layer.

In the invention, a film thickness of this auxiliary sensitizing layer is set to be not smaller than 20 Å and not larger than 500 Å, preferably, not smaller than 50 Å and not larger than 500 Å.

Due to this, as compared with the image pickup tube using a photoconductive film having an auxiliary sensitizing layer of a film thickness that has been proposed conventionally, the variation in sensitivity just after the image pickup tube is switched on can be obviously reduced without losing the sensitizing effect for light.

FIG. 3 is an example of component distribution for explaining the present invention. The composition ratio in the description of the invention is shown as a weight % hereinafter. In the example of FIG. 3, Te doesn't exist at all at the position corresponding to the interface with the transparent electrode where the film thickness is zero (portion A). The concentration of this Te rapidly increases from the portion of the film thickness of 500 Å and Te is added into the region over the film thickness of 1000 Å (portion B) at the concentration of 30%. As is uniformly distributed in the direction of the film thickness so as to have concentrations of 6% in the portion A and 3% in the portion B. This constitution of Te and As is the same as that in the case of FIG. 2 in principle. The portion of an auxiliary sensitizing layer C differs from that in FIG. 2. The film thickness of the portion C is 50 Å and the concentration of As in this portion is 20% and As is uniformly distributed in the direction of the film thickness. On one hand, $GaF_3$ of the concentration of 1500 ppm is uniformly distributed in the direction of the film thickness in the portion C.

In the example of FIG. 3, As and $GaF_3$ are uniformly distributed in the whole portion C so that they have constant concentrations in the directions of their thicknesses. However, they are not necessarily uniform but they may have variable concentrations. For example, both of As and $GaF_3$ may be simultaneously, or individually, or partially simultaneously added in the overall portion C. In addition, the portion C is constituted by Se, As and $GaF_3$ in the example of FIG. 3. However, according to the present invention, Te may be included in at least a part of this portion and its concentration may be uniformly distributed in the direction of the film thickness or may have a gradient or variation. On the other hand, in place of As, it is also possible to use a substance which, it is considered, forms a deep electron trap level in Se, namely, either one of Bi, Sb, Ge, and S, or to use a plurality of elements selected from a group consisting of As and the above-mentioned elements.

What are important are that the film thickness of the portion C is set to be not smaller than 20 Å and not larger than 500 Å, further preferably, not smaller than 50 Å and not larger than 500 Å and that a substance for forming negative space charges in Se, namely, at least one selected from a group consisting of CuO, $In_2O_3$, $SeO_2$, $V_2O_5$, $MoO_3$, $WO_3$, $GaF_3$, $InF_3$, Zn, Ga, In, Cl, I, and Br is contained in the region whose thickness is not smaller than 20 Å and not larger than 90 Å in at least a part of the portion C. It is desirable that the concentration of the substance for forming a deep electron trap level in Se which is added into the portion C is not smaller than 1% and not larger than 30%. It is desirable that the concentration of the foregoing substance for forming negative space charges is not smaller than 10 ppm and not larger than 1%. In the case where those concentrations are below the above-mentioned values, the effect as the auxiliary sensitizing layer is lost and the sensitivity just after the image pickup tube is switched on varies so as to be degraded. On the contrary, in the case where they are over the above-mentioned values, the variation of the sensitivity in the increasing direction will become large.

In addition, a method for improving the lag for the strong light by adding a fluoride LiF, $CaF_2$ or the like for forming a shallow trap level in the portions of the regions A and B where most of the signal current is produced has been proposed (U.S. Pat. No. 4,330,733). This method can be applied to the present invention, where in the reduction of the variation in the sensitivity just after the image pickup tube is switched on, which is an object of the present invention, can be attained without losing the lag improvement effect for the strong light.

DESCRIPTION OF THE PREFERRED EMBODIMENT

Figure 1:
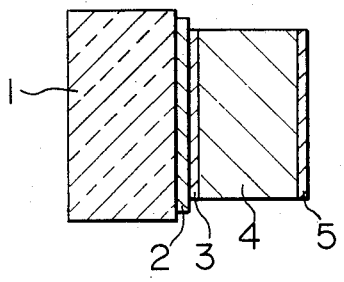
FIG. 1 PRIOR ART
FIG. 1 is a principle structure diagram of a target of an image pickup tube according to a conventional technology.
Figure 2:
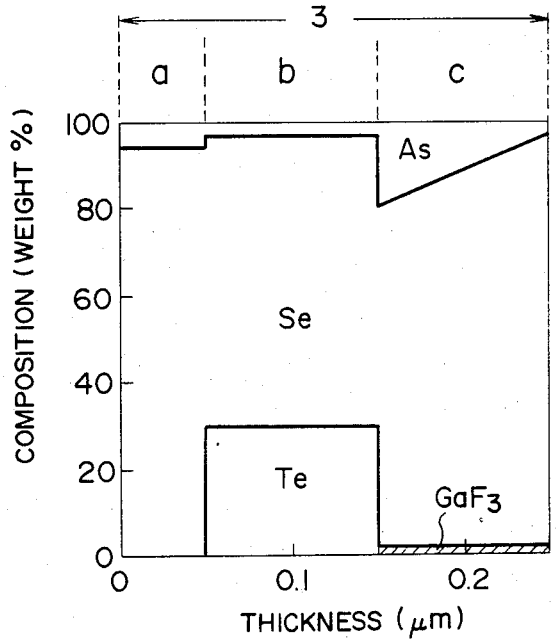
FIG. 2 PRIOR ART
FIG. 2 is a diagram showing an example of component distribution in the sensitizing region of the image pickup tube target shown in FIG. 1.
Figure 3:
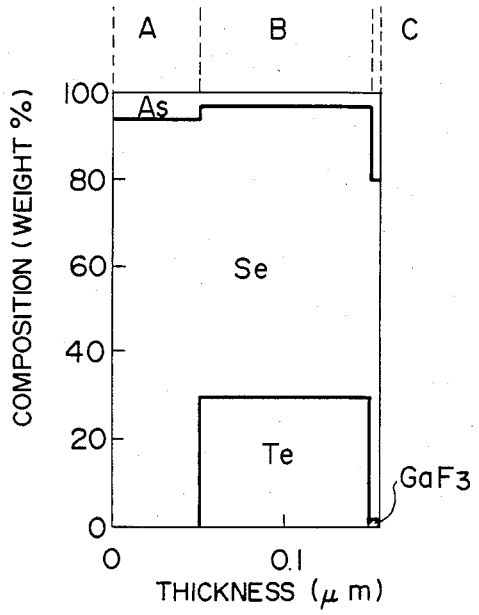
FIG. 3 is a diagram showing an example of component distribution in the sensitizing region of a target of an image pickup tube to which the present invention is applied.

A photoconductive film according to the present invention will be described hereinbelow by way of examples.

EXAMPLE 1

A transparent electrode mainly consisting of tin oxide is formed on a glass substrate. Further, as an auxiliary rectifying contact layer, $GeO_2$ of a thickness of 200 Å and $CeO_2$ of a thickness of 200 Å are deposited under the vacuum of $3\times10^{-6}$ Torr. Substances Se and $As_2Se_3$ are deposited as the first layer on this auxiliary layer from different evaporation sources to have thickness of 100 to 500 Å. This As is uniformly distributed in the direction of the thickness so that its concentration is 6%. Subsequently, Se, $As_2Se_3$ and Te are evaporated from different sources to form the second layer having a thickness of 500 to 1000 Å. At this time, Te and As are uniformly distributed in the direction of the thickness so that their concentrations are 35 to 25% and 2%. The third layer consisting of Se, As and $In_2O_3$ is deposited as an auxiliary sensitizing layer on the second layer to have a thickness of 50 to 90 Å. In deposition of the third layer, Se, $As_2Se_3$ and $In_2O_3$ are simultaneously evaporated from different sources. At this time, these As and $In_2O_3$ are uniformly distributed in the direction of the thickness so that their concentrations are 20% and 500 ppm. Substances Se and $As_2Se_3$ are simultaneously deposited as the fourth layer on the third layer so that the whole thickness becomes 6 μm. In this case, As in the fourth layer is uniformly distributed in the direction of the thickness so as to have a concentration of 2%. Deposition for forming the first to the fourth layers is carried out under the vacuum of $2\times10^{-6}$ Torr. As a beam landing aiding layer, $Sb_2S_3$ of a thickness of 1000 Å is deposited on the fourth layer in the argon atmosphere of $2\times10^{-1}$ Torr.

EXAMPLE 2

A transparent electrode mainly consisting of tin oxide is formed on a glass substrate, then Se and $As_2Se_3$ are respectively deposited as the first layer on this electrode from different evaporation sources so as to have a thickness of 300 Å. This As is uniformly distributed in the direction of the thickness to have a concentration of 6%. As the second layer, Se, $As_2Se_3$ and Te are respectively evaporated from different sources and are deposited on the first layer so as to have a thickness of 500 Å. These Te and As are uniformly distributed in the direction of the thickness so that their concentrations are 35% and 2%. The third layer is deposited on the second layer. For the third layer, Se, $As_2Se_3$ and $In_2O_3$ are first deposited respectively as the former half portion from different sources to have a thickness of 50 Å. In this region, As and $In_2O_3$ are uniformly distributed in the direction of the thickness so that their concentrations are 25% and 300 ppm. Further, as the latter half portion of the third layer, Se, $As_2Se_3$ and $In_2O_3$ are respectively deposited thereon from different sources to have a thickness of 30 Å. These As and $In_2O_3$ are uniformly distributed in the direction of the thickness so that their concentrations are 3% and 300 ppm. The combination of these former and latter half portions of the third layer constitutes the auxiliary sensitizing layer. Next, the fourth layer consisting of Se and As is deposited so that the whole thickness becomes 4 μm. In the fourth layer, As is uniformly distributed in the direction of the thickness to have a concentration of 3%. Deposition for forming the first to the fourth layers is carried out under the vacuum of $2\times10^{-6}$ Torr. A $Sb_2S_3$ layer of a thickness of 750 Å is deposited on the fourth layer in the argon atmosphere of $3\times10^{-1}$ Torr.

EXAMPLE 3

A transparent electrode mainly consisting of indium oxide is formed on a glass substrate and $CeO_2$ of a thickness of 300 Å is further deposited as an auxiliary rectifying contact layer on this electrode under the vacuum of $3\times10^{-6}$ Torr. Then Se and $As_2Se_3$ are deposited as the first layer on that auxiliary layer from different sources to have a thickness of 200 Å. In this case, As is uniformly added in the direction of the thickness so as to have a concentration of 3%. Subsequently, as the second layer, Se, $As_2Se_3$ and Te are deposited from different sources to have a thickness of 600 Å. In this case, Te and As are uniformly distributed in the direction of the thickness so that their concentrations are 30% and 3%. The first and second layers constitute the photosensitive layer. As an auxiliary sensitizing layer, the third layer consisting of Se, As and $GaF_3$ is deposited on the second layer. In deposition of the third layer, Se and $As_2Se_3$ are first deposited from different sources to have a thickness of 20 Å. At this time, As is uniformly distributed in the direction of the thickness so as to have a concentration of 25%. Further, Se, $As_2Se_3$ and $GaF_3$ are deposited on this layer from different sources to have a thickness of 50 Å. At this time, As and $GaF_3$ are uniformly distributed in the direction of the thickness so that their concentrations are 2% and 1000 ppm. In this way, deposition of the third layer is finished. Then, the fourth layer is deposited. For the fourth layer, Se and $As_2Se_3$ are simultaneously deposited from different sources so that the whole thickness of the first to fourth layers becomes 5 μm. In the fourth layer, As is uniformly distributed in the direction of the thickness to have a concentration of 2%. Deposition for forming the first to the fourth layers is carried out under the vacuum of $3\times10^{-6}$ Torr. A $Sb_2S_3$ layer of a thickness of 1000 Å is deposited on the fourth layer in the argon atmosphere of $2\times10^{-1}$ Torr.

EXAMPLE 4

A transparent electrode mainly consisting of indium oxide is formed on a glass substrate and $CeO_2$ of a thickness of 200 Å is further deposited as an auxiliary rectifying contact layer on this electrode. This deposition is performed under the vacuum of $2\times10^{-6}$ Torr. Subsequently, the first layer is deposited in accordance with the following procedure. First, Se, $As_2Se_3$ and LiF are deposited from different sources to have a thickness of 80 to 300 Å. In this case, As and LiF are uniformly distributed in the direction of the thickness so that their concentrations are 6% and 1000 ppm. Further, Se, $As_2Se_3$ and LiF are deposited thereon from different sources to have a thickness of 60 Å. In this case, As and LiF are uniformly distributed in the direction of the thickness so that their concentrations are 10% and 6000 ppm. In this way, the deposition of the first layer is finished. The second layer is deposited on the first layer. For the second layer, Se, $As_2Se_3$, Te, and LiF are first deposited from different sources to have a thickness of 250 Å. At this time, As, Te and LiF are uniformly distributed in the direction of the thickness so that their concentrations are 2%, 33% and 3000 ppm. Moreover, Se, $As_2Se_3$ and Te are deposited thereon from different sources to have a thickness of 250 Å. In this case, As and Te are uniformly distributed in the direction of the thickness so that their concentrations are 2% and 33%. In this way, the deposition of the second layer is finished. Next, the third layer is deposited. For the third layer, Se, $As_2Se_3$ and $GaF_3$ are first deposited from different sources to have a thickness of 50 Å. At this time, As and $GaF_3$ are uniformly distributed in the direction of the thickness so that their concentrations are 20% and 1500 ppm. Further, Se and $As_2Se_3$ are deposited thereon from different sources to have a thickness of 300 to 450 Å. In this case, As is uniformly distributed in the direction of the thickness to have a concentration of 10%. As described above, the deposition of the third layer serving as the auxiliary sensitizing layer is finished. Next, the fourth layer consisting of Se and As is deposited. For the fourth layer, Se and $As_2Se_3$ are deposited from different sources so that the whole thickness of the first to fourth layers becomes 6 μm. In the fourth layer, As is uniformly distributed in the direction of the thickness to have a concentration of 25%. Deposition for forming the first to the fourth layers is carried out under the vacuum of $2\times10^{-6}$ Torr. Subsequently, as a beam landing aiding layer, $Sb_2S_3$ of a thickness of 750 Å is deposited in the argon atmosphere of $2\times10^{-1}$ Torr.

EXAMPLE 5

A transparent electrode mainly consisting of tin oxide is formed on a glass substrate and Se of a thickness of 80 to 300 Å is deposited as the first layer on this electrode. Then, Se and Te are deposited respectively from different sources, thereby forming the second layer having a thickness of 600 Å. In this case, Te is uniformly distributed in the direction of the thickness to have a concentration of 30%. Next, as the third layer, Se and $In_2O_3$ are deposited from different sources to have a thickness of 90 Å. In this case, $In_2O_3$ is uniformly distributed in the direction of the thickness to have a concentration of 1000 ppm. Se of a thickness of 4 μm is deposited on the third layer. Deposition for forming the first to the fourth layers is carried out under the vacuum of $2\times10^{-6}$ Torr. $Sb_2S_3$ of a thickness of 1000 Å is deposited on the fourth layer in the argon atmosphere of $2\times10^{-1}$ Torr, thereby forming the electron beam landing aiding layer. By adding As or Ge of below 10% in the foregoing first to fourth layers, crystallization of Se is prevented and the thermal stability can be improved.

EXAMPLE 6

A transparent electrode mainly consisting of indium oxide is formed on a glass substrate and further $GeO_2$ of a thickness of 200 Å and $CeO_2$ of a thickness of 200 Å are deposited as an auxiliary rectifying contact layer on this electrode under the vacuum of $3\times10^{-6}$ Torr. As the first layer, Se and $As_2Se_3$ are deposited thereon from different sources to have a thickness of 80 to 300 Å. In this case, As is uniformly distributed in the direction of the thickness to have a concentration of 5%. Next, Se, $As_2Se_3$ and Te are evaporated from different sources to form the second layer of a thickness of 500 to 1000 Å. At this time, Te and As are uniformly distributed in the direction of the thickness so that their concentrations are 35 to 25% and 3%. The third layer is deposited as an auxiliary sensitizing layer on the second layer. For the third layer, as the former half portion, Se, $As_2Se_3$ and Te are first deposited respectively from different sources to have a thickness of 50 to 20 Å. In this case, As and Te are uniformly distributed in the direction of the thickness so that their concentrations are 3 to 10% and 40 to 20%. Subsequently, as the latter half portion of the third layer, Se, $As_2Se_3$ and $In_2O_3$ are deposited from different sources to have a thickness of 20 to 70 Å. At this time, As and $In_2O_3$ are uniformly distributed in the direction of the thickness so that their concentrations are 20% and 500 ppm. These former and latter half portions constitute the third layer whose total thickness is 50 to 100 Å. Subsequently, the fourth layer consisting of Se and As is deposited so that the whole thickness becomes 6 μm. In the fourth layer, As is uniformly distributed in the direction of the thickness so as to have a concentration of 2%. The respective compositions in the first to the fourth layers are deposited under the vacuum of $2\times10^{-6}$ Torr. $Sb_2S_3$ of a thickness of 1000 Å is deposited on the fourth layer in the argon atmosphere of $3\times10^{-1}$ Torr.

EXAMPLE 7

A transparent electrode mainly consisting of indium oxide is formed on a glass substrate and further $CeO_2$ of a thickness of 300 Å is deposited as an auxiliary rectifying contact layer on this electrode under the vacuum of $3\times10^{-6}$ Torr. As the first layer, Se and $As_2Se_3$ are respectively deposited thereon from different sources to have a thickness to 200 Å. At this time, As is uniformly distributed in the direction of the thickness to have a concentration of 3%. Next, as the second layer, Se, $As_2Se_3$ and Te are simultaneously evaporated from different sources and are deposited to have a thickness of 600 Å. In this case, Te and As are uniformly distributed in the direction of the thickness so that their concentrations are 33% and 3%. The third layer is deposited on the second layer. For the third layer, as the former half portion, Se, $As_2Se_3$, Te, and $GaF_3$ are respectively deposited from different sources to have a thickness of 30 Å. At this time, Te, As and $GaF_3$ are uniformly distributed in the direction of the thickness so that their concentrations are 10 to 25%, 3% and 1500 ppm. Subsequently, as the latter half portion of the third layer, Se, $As_2Se_3$ and $GaF_3$ are deposited from different sources to have a thickness of 30 Å. In this case, As and $GaF_3$ are uniformly distributed in the direction of the thickness so that their concentrations are 10 to 20% and 1000 ppm. As described above, the deposition of the third layer whose total thickness is 60 Å is finished. Next, the fourth layer is deposited. For the fourth layer, Se and $As_2Se_3$ are simultaneously deposited from different sources so that the whole thickness of the first to the fourth layers becomes 5 μm. In the fourth layer, As is uniformly distributed in the direction of the thickness to have a concentration of 2%. Deposition for forming the first to the fourth layers is carried out under the vacuum of $3\times10^{-6}$ Torr. $Sb_2S_3$ of a thickness of 500 Å is deposited on the fourth layer in the argon atmosphere of $4\times10^{-1}$ Torr.

By embodying the present invention, the variation in the sensitivity which is caused just after the image pickup tube is switched on can be improved. Although the physical comprehension of this effect is not sufficiently elucidated yet, it is considered such that by making the thickness of the auxiliary sensitizing layer (third layer) so thin to be 20 to 500 Å, the electrons excited in this portion by the light become difficult to be captured at the trap levels and this makes it possible to suppress the variation in the space charges in the auxiliary sensitizing layer, which variation becomes a cause of the variation in the sensitivity just after the image pickup tube is switched on.

Figure 4:
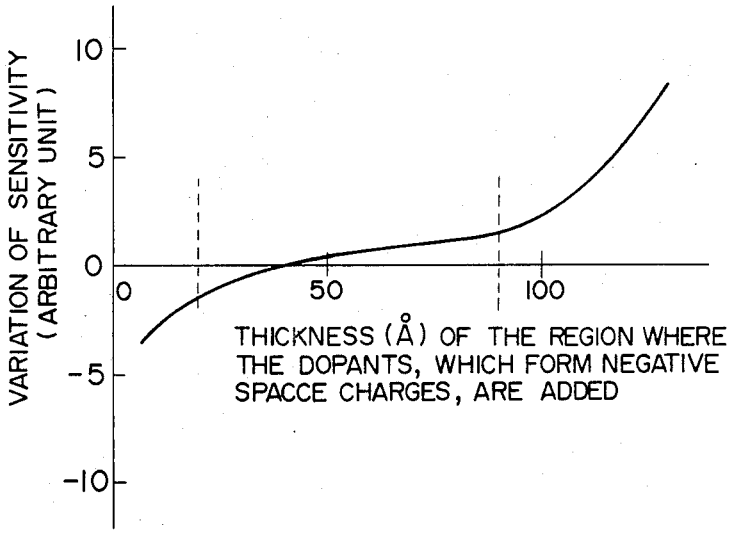
FIG. 4 is a diagram showing the variation in sensitivity just after the image pickup tube is switched on to the variation in film thickness in the region where the dopants, which form negative space charges, are added.

FIG. 4 shows the relation between the thickness of the region, where the dopants which form negative space charges in Se are added, and the variation in the sensitivity. In the case where the thickness of the region where the dopants are added is over 100 Å, the variation of the sensitivity starts increasing. On the contrary, when this thickness is too thin, it is difficult to stably derive the sensitivity variation decreasing effect. A desirable thickness is nor smaller than 20 Å and not larger than 90 Å.

Figure 5:
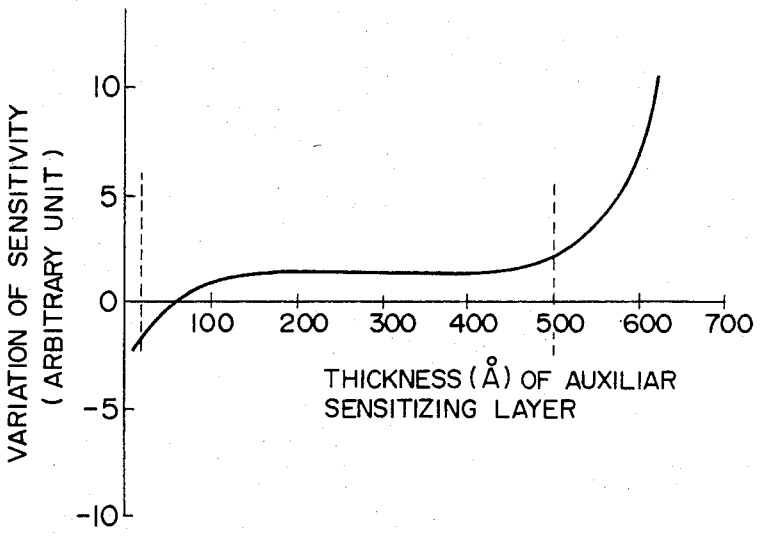
FIG. 5 is a diagram showing the variation in sensitivity just after the image pickup tube is switched on to the variation of the thickness of the auxiliary sensitizing layer.

FIG. 5 shows the variation in the sensitivity just after the image pickup tube is switched on. An axis of abscissa denotes the thickness of the auxiliary sensitizing layer and an axis of ordinate represents the variation in the sensitivity. In FIG. 4, if the thickness of the auxiliary sensitizing layer is too thick, the sensitivity variation suddenly increases in the positive direction. On the contrary, if it is too thin, the sensitivity variation increases in the negative direction. A desirable thickness is not smaller than 20 Å and not larger than 500 Å.

Although the present invention is made for the target of the image pickup tube, it is obvious that the invention can be also applied to a photosensing device using similar materials.

We claim:

1. A photoconductive film mainly consisting of Se and sensitized by adding tellurium into a portion in the direction of thickness of the photoconductive film so as to form a Te-doped region, in which at least one selected from a group consisting of such oxides and fluorides that form negative space charges in selenium and such elements that belong to the group II, III or VII and form negative space charges in selenium is contained in either of at least a portion of the Te-doped region and at least a portion of the region adjacent to said Te-doped region, or in both of said portions, at an average weight % concentration of not smaller than 10 ppm and not larger than 1%, wherein a film thickness where such dopant that forms negative space charges in selenium is contained is selected to be not smaller than 20 Å and not larger than 90 Å.

2. A photoconductive film according to claim 1, wherein said oxide which forms the negative space charges in selenium is at least one selected from a group consisting of CuO, $In_2O_3$, $SeO_2$, $V_2O_5$, $MoO_3$, and $WO_3$, and said fluoride which forms the negative space charges in selenium is at least either $GaF_3$ or $InF_3$, and said element which belongs to the group II, III, or VII and forms the negative space charges in selenium is at least one selected from a group consisting of Zn, Ga, In, Cl, I, and Br.

3. A photoconductive film according to claim 2, wherein a region of a thickness of not smaller than 20 Å and not larger than 500 Å adjacent to said Te-doped region contains at least one element selected from a group consisting of As, Bi, Sb, Ge, and S at a concentration of not smaller than one weight % and not larger than 30 weight % as an average.

4. A photoconductive film according to claim 3, wherein at least one selected from a group consisting of LiF, $MgF_2$, $CaF_2$, $AlF_3$, $CrF_3$, $MnF_2$, $CoF_2$, $PbF_2$, $BaF_2$, $CeF_3$, and TlF is contained in at least a portion of the region which absorbs an incident light and produces most of a signal current so as to have a concentration of not smaller than 50 ppm and not larger than 5% as a weight average.

5. A photoconductive film according to claim 3, wherein the region adjacent to the Te-doped region has a thickness of 50 Å to 500 Å.

6. A photoconductive film according to claim 1, wherein an auxiliary sensitizing layer for forming electron-capturing levels and enhancing the sensitizing effect is disposed adjacent said Te-doped region; and wherein said at least one selected from a group consisting of such oxides and fluorides that form negative space charges in selenium and such elements that belong to the group II, III or VII and form negative space charges in selenium is contained in either of at least a portion of said Te-doped region and at least a portion of said auxiliary sensitizing layer, or in both of said portions.

7. A photoconductive film according to claim 6, wherein the thickness of said auxiliary sensitizing layer is selected to be not smaller than 20 Å and not larger than 500 Å.

8. A photoconductive film according to claim 7, wherein said auxiliary sensitizing layer comprises at least one material which forms electron-capturing levels in Se, contained in Se, said at least one material being contained in Se at an average concentration of not lower than 1 weight % and not higher than 30 weight %.

9. A photoconductive film according to claim 8, wherein said at least one material is selected from the group consisting of As, Bi, Sb, Ge and S.

10. A photoconductive film according to claim 9, wherein the oxides and fluorides, and elements belonging to group II, III or VII, that form negative space charges in selenium, are selected from the group consisting of CuO, $In_2O_3$, $SeO_2$, $V_2O_5$, $MoO_3$, $WO_3$, $GaF_3$, $InF_3$, Zn, Ga, In, Cl, I and Br.

11. A photoconductive film mainly consisting of Se and sensitized by adding tellurium into a portion in the direction of thickness of the photoconductive film so as to form a Te-doped region, with an auxiliary sensitizing layer for forming electron-capturing levels and enhancing the sensitizing effect being disposed adjacent to said Te-doped region, wherein said auxiliary sensitizing layer has a thickness of not smaller than 20 Å and not larger than 500 Å.

12. A photoconductive film according to claim 11, wherein said auxiliary sensitizing layer comprises at least one material which forms electron-capturing levels in Se, contained in Se, said at least one material being contained in Se at an average concentration of not lower than 1 weight % and not higher than 30 weight %.

13. A photoconductive film according to claim 12, wherein said at least one material is selected from the group consisting of As, Bi, Sb, Ge and S.

* * * * *